US007228910B2

(12) United States Patent
Howlett

(10) Patent No.: US 7,228,910 B2
(45) Date of Patent: Jun. 12, 2007

(54) SAFETY MECHANISM FOR WEIGHT-SET DOWNHOLE TOOL

(75) Inventor: Paul David Howlett, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 261 days.

(21) Appl. No.: 10/494,234

(22) PCT Filed: Nov. 5, 2002

(86) PCT No.: PCT/GB02/05009

§ 371 (c)(1),
(2), (4) Date: Oct. 12, 2004

(87) PCT Pub. No.: WO03/040516

PCT Pub. Date: May 15, 2003

(65) Prior Publication Data

US 2005/0045338 A1 Mar. 3, 2005

(30) Foreign Application Priority Data

Nov. 6, 2001 (GB) ..... 0126550.3

(51) Int. Cl.
*E21B 23/00* (2006.01)

(52) U.S. Cl. ..... 166/373; 166/237

(58) Field of Classification Search ..... 166/216, 166/237, 373, 387, 118, 196, 136, 99, 98
See application file for complete search history.

(56) References Cited

U.S. PATENT DOCUMENTS

| | | | | |
|---|---|---|---|---|
| 191,131 | A | 5/1877 | Gainey | |
| 402,738 | A | 5/1889 | Hyatt | |
| 2,066,479 | A | 1/1937 | MacIsaac | 210/167 |
| 3,357,566 | A | 12/1967 | Schmid et al. | 210/333 |
| 3,568,414 | A | 3/1971 | Spriggs et al. | 55/294 |
| 4,002,567 | A | 1/1977 | Konno et al. | 210/333 |
| 4,060,483 | A | 11/1977 | Barzuza | 210/79 |
| 4,090,962 | A | 5/1978 | Braukmann | 210/108 |
| 4,378,839 | A * | 4/1983 | Fisher, Jr. | 166/217 |

(Continued)

FOREIGN PATENT DOCUMENTS

| | | |
|---|---|---|
| EP | 460842 | 12/1991 |

OTHER PUBLICATIONS

Filtomat, Inc. Advertisement "Water filter puts algae in their place," Grounds Maintenance, p. 56 (Oct. 1989).

(Continued)

*Primary Examiner*—David Bagnell
*Assistant Examiner*—Daniel P Stephenson
(74) *Attorney, Agent, or Firm*—C. Dean Domingue; Robert L. Waddell; Ted M. Anthony

(57) ABSTRACT

A safety trip button (12) is described for a weight-set downhole tool. The button operates between the tool body (36) and a sleeve (34) of the tool, locking them initially together. When the tool reaches a selected formation (44) in a well bore, the button engages the formation (44) which unlocks the body and sleeve. The button is kept in the unlocked position by virtue of the formation while the tool is set. The button prevents premature setting of the tool and finds application on weight set tools such as packers and circulation tools.

31 Claims, 4 Drawing Sheets

U.S. PATENT DOCUMENTS

| | | | | |
|---|---|---|---|---|
| 4,545,434 | A | 10/1985 | Higgins | |
| 4,692,247 | A | 9/1987 | Orlans | 210/314 |
| 4,765,402 | A | 8/1988 | Smith, Jr. | |
| 5,366,019 | A * | 11/1994 | Brooks | 166/387 |
| 5,692,564 | A | 12/1997 | Brooks | |
| 5,824,229 | A | 10/1998 | Larkey et al. | 210/741 |
| 5,996,697 | A * | 12/1999 | Vick et al. | 166/386 |
| 6,267,879 | B1 | 7/2001 | Shemuel | 210/107 |
| 2002/0157824 | A1* | 10/2002 | French et al. | 166/250.01 |
| 2004/0026087 | A1* | 2/2004 | Dennistoun et al. | 166/373 |

OTHER PUBLICATIONS

Eagle Publications Advertisement "Filtration News, Special Emphasis: Filter Media Filtration 2002 Show Issue" Eagle Publications, Inc., pp. 17, 30 (Sep. 2002).

Zurn Industries, Inc. Owner's Catalogue "Self-Cleaning Pipeline Strainers" Zurn Industries, Inc. (Oct. 1974).

* cited by examiner

SAFETY MECHANISM FOR WEIGHT-SET DOWNHOLE TOOL

BACKGROUND OF THE INVENTION

The present invention relates to safety features in downhole tools and in particular to a safety trip button to prevent premature setting in weight set downhole tools.

A number of downhole tools as used in the oil and gas industry are operated within a well bore by contacting or landing part of the tool onto a formation located within the well bore. Typically a sleeve of the tool is landed on a liner top PBR (polished bore receptacle), causing the weight of the tool to force the tool into the liner while the sleeve remains stationary on the liner top. The relative movement of the sleeve on the tool body operates the tool, for example by opening radial ports or by compressing a packer.

In order that the sleeve does not move when the tool is inserted or run into the well bore, shear pins are typically inserted between the tool body and the sleeve to hold the sleeve in place. When the tool is landed on the liner top, the relative movement of the sleeve to the tool body causes the pins to shear thereby allowing operation of the tool.

A major disadvantage of these weight set tools is that they can be operated by the sleeve contacting any formation in the well bore. For example if the sleeve comes into contact with debris adhering to the walls of the casing or at a casing joint where the internal casing diameters are mismatched, the sleeve may be jarred or stick at that point in the well bore. Once stationary the tool body may be free to fall with a sufficient relative force to shear the pins. Thus the tool will be activated and operate at the incorrect position in the well bore.

It is an object of at least one embodiment of the present invention to provide a safety mechanism to prevent premature setting of a weight set tool in a well bore.

It is a further object of at least one embodiment of the present invention to provide a safety trip button which shears only when a weight set tool contacts a selected formation in a well bore.

It is a yet further object of at least one embodiment of the present invention to provide a compression set packer tool which includes a safety mechanism to prevent premature setting of the packer.

SUMMARY OF THE INVENTION

According to a first aspect of the present invention there is provided a safety mechanism for use in a weight set downhole tool to prevent the tool from setting before an operating element of the tool has landed on a selected formation in a well bore, the mechanism comprising a button mounted in a first position to lock the operating element to the tool body, the button having a face engageable with the selected formation, whereupon engagement with the selected formation moves the button from the first position to a second position, disengaging the lock, and wherein the selected formation maintains the button in the second position while the selected formation contacts the operating element thereby setting the tool.

As the tool cannot be set until the selected formation provides the dual role of holding the button in the second position and contacting the operating element, it is unlikely that any unintended formation in the well bore could achieve this and thus the tool will not operate until it reaches the selected formation.

Preferably the button comprises a cylindrical body which is mounted through a portion of the operating element and a portion of the tool body to lock each together. Locking prevents the operating element from moving in relation to the tool body so that the tool can be run into the well bore.

Preferably also the safety mechanism includes retaining means to hold the button to the operating portion and the tool body once the tool is set. The retaining means may be one or more bissell pins. The one or more bissell pins may be shearable. The retaining means may be a magnet, the magnet being mounted on a surface to attract another surface and hold the two surfaces together.

Preferably the face of the button is held proud of the tool in the first position. Preferably the surface is located facing the selected formation. More preferably the face is a plane surface located at an acute angle to the tool in the first position. Thus as the formation rides past the face it forces the button towards the tool into the second position.

More preferably the button includes a shearable section. The shearable section may be a narrower portion of the button, a portion of the button made of a differing material or a combination thereof. When the button is in the second position the lock is disengaged by the movement of the shearable section to a position where it may be sheared.

In a preferred embodiment the operating element is a sleeve and the selected formation is a polished bore receptacle.

According to a second aspect of the present invention there is provided a weight set downhole tool, the tool including a tool body mountable on a work string, an operating element slidably mounted on the tool body which operates the tool by contacting a formation in a well bore, shearable retaining means to hold the operating element to the tool body until such time as adequate force is applied to shear the retaining means, and a safety mechanism to prevent shearing of the retaining means until the operating element has contacted a selected formation.

Preferably the operating element is a sleeve.

Preferably the shearable retaining means is one or more shear pins.

Preferably the selected formation is a polished bore receptacle.

Preferably the safety mechanism is according to the first aspect.

Preferably the downhole tool is a circulation tool. Preferably also the downhole tool may be a packer tool.

Preferably the downhole tool further comprises an integral bypass means to allow fluid to pass through the tool as it is run into the well bore. More preferably the bypass means are ports or channels. The bypass means may by opened or closed by virtue of the movement of the operating element when the tool is set.

Preferably also the downhole tool includes cleaning means. The cleaning means may be brushes, scrapers or milling elements. Preferably the cleaning means are mounted below the operating element so that they reach the formation prior to the operating means. Alternatively the cleaning means may be located on the operating element so that unwanted formations such as debris can be removed before contacting the safety mechanism.

According to a third aspect of the present invention there is provided a method of preventing a weight set downhole tool setting prematurely before an operating element of the tool has landed on a selected formation, the method comprising the steps:

(a) running a weight set downhole tool including a safety mechanism into a well bore on a work string;

(b) engaging a face of the safety mechanism on to the selected formation to move the safety mechanism to a released position; and (c) engaging the operating element on to the selected formation to set the tool while the selected formation maintains the safety mechanism in the released position.

Preferably the method includes the step of shearing the safety mechanism when the tool is set.

BRIEF DESCRIPTION OF THE DRAWINGS

An embodiment of the present invention will now be described by way of example only with reference to the following drawings of which.

DETAILED DESCRIPTION OF THE PREFERRED EMBODIMENTS

Figure 1:
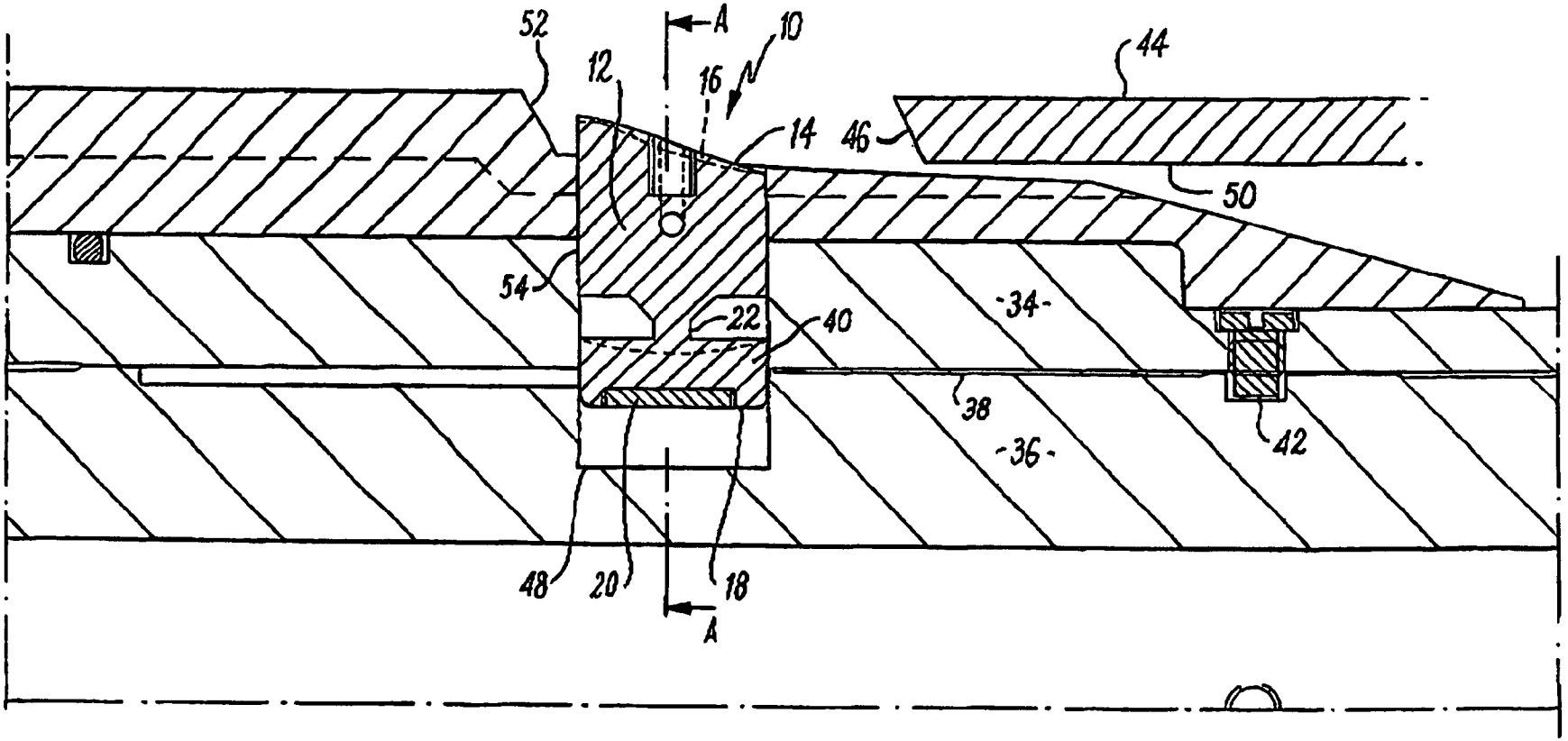
FIG. 1 is a schematic cross sectional view through a downhole tool including a safety mechanism in accordance with a preferred embodiment of the present invention.

Reference is initially made to FIG. 1 of the drawings which illustrates a safety mechanism, generally indicated by reference numeral 10, in accordance with a preferred embodiment of the present invention. Safety mechanism 10 comprises a cylindrical body or button 12. On one end 14 of the button 12 there is a contact face 16. Face 16 is planar and located at an acute angle to the button 12. At the opposing end 18 there is located a magnet 20. Located between opposing ends 14,18 is a narrowed section 22 of the button 12. The narrowed section provides a weak point on the button 12 making it susceptible to shearing across the narrow section 22. It will be appreciated that instead of a narrow section the button could include a section of differing material which is weaker than the remaining material and be equally susceptible to shearing.

Figure 2:
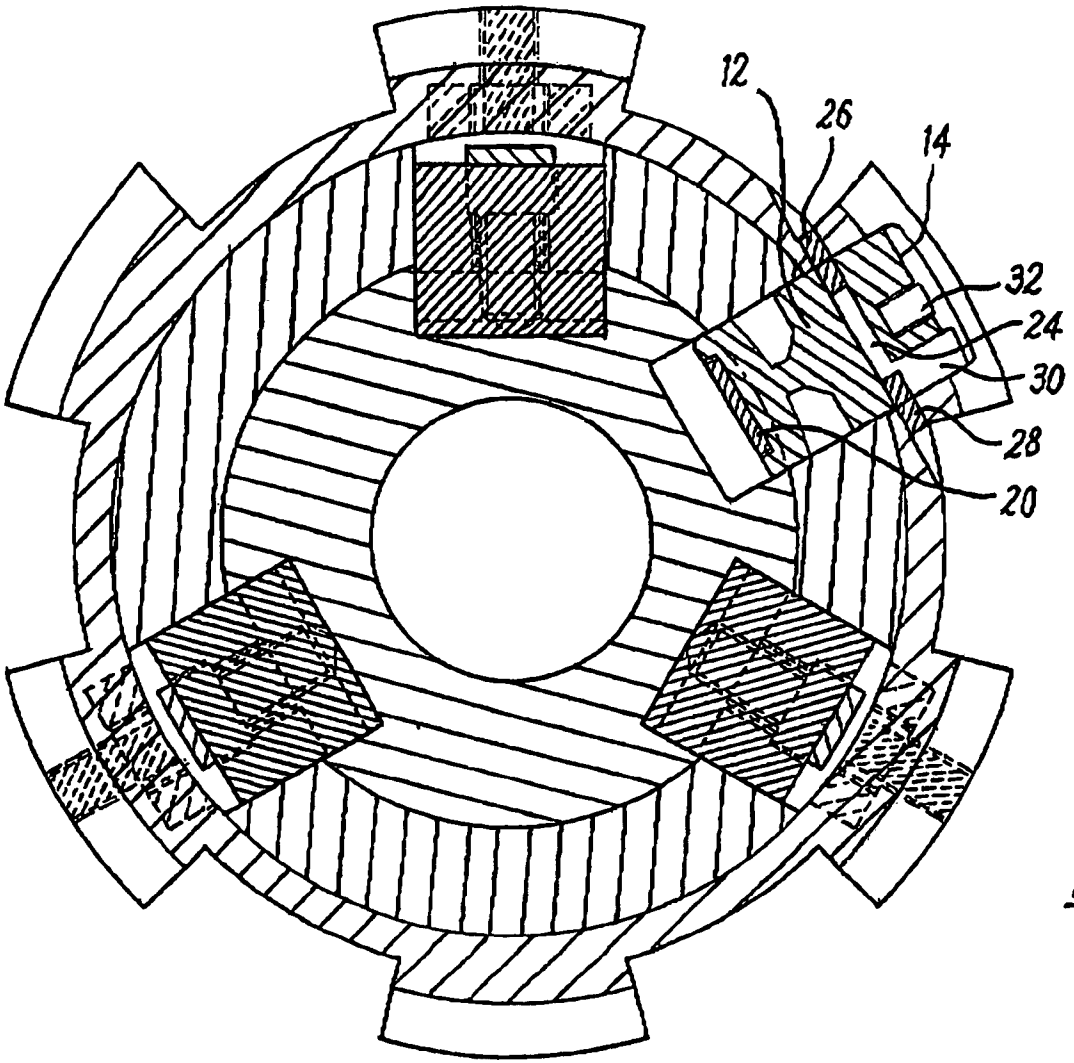
FIG. 2 is a schematic cross sectional view through section A–A' of FIG. 1.

Further features of the button 12 can be seen with the aid of FIG. 2. Through the button 12 is located a channel 24 at each end of which are inserted bissell pins 26,28. At one end of the channel 24 there is an opening 30 wide enough to clear the bissell pin 28. No such opening is located at the other end of the channel 24. Located at end 14 there is an aperture 32. Aperture 32 includes a screw thread such that the button may be removed by insertion of a mating screw into the aperture 32.

In use, the button 12 is inserted through a portion of a sleeve 34 and a tool body 36, to which the sleeve 34 is located on. The bissel pins 26, 28 locate into the sleeve 34 such that the narrow section 22 is kept away from the shear plane 38 located between the sleeve 34 and the tool body 36.

When the tool is inserted in a well bore (not shown) the sleeve 34 may come into contact with any irregularities or protrusions from the walls of the well bore. For instance debris or cuttings may adhere to walls of a casing while joints in the casing or liner may be mismatched leaving ledges. On contacting these formations the sleeve 34 may stick or become jarred. Once stationary the weight bearing down on the tool body 36 will cause a force to exist between the sleeve 34 and the tool body 36 along the shear plane 38. Ordinarily this force may be sufficient to cause the standard shear pins 42, retaining the sleeve 34 to the tool body 36, to shear and as a result the tool would set at that point in the well bore. However, with the safety mechanism 10 in the position shown in FIG. 1, the first position, the sleeve 34 and tool body 36 are prevented from shearing apart by virtue of the section 40 of the button 12 lying across the shear plane 38. Thus premature setting of the tool is avoided.

When the tool reaches a selected formation 44, in this case a polished bore receptacle (PBR) on a liner top, upper surface 46 of the PBR 44 will engage with the contact face 16 of the button 12. As the tool moves into the liner the face 16 and surface 44 will ride over each other with the result that the button 12 will be pushed in towards a recess 48 in the tool body 36. The force exerted by the PBR 44 on the button 12 is sufficient to break a first bissell pin 26. The opening 30 around the second bissell pin 28 allows the button to shift from a first position, sitting proud of the sleeve 34, to a second position within recess 48, while still retaining the button 12 to the sleeve 34.

Figure 3:
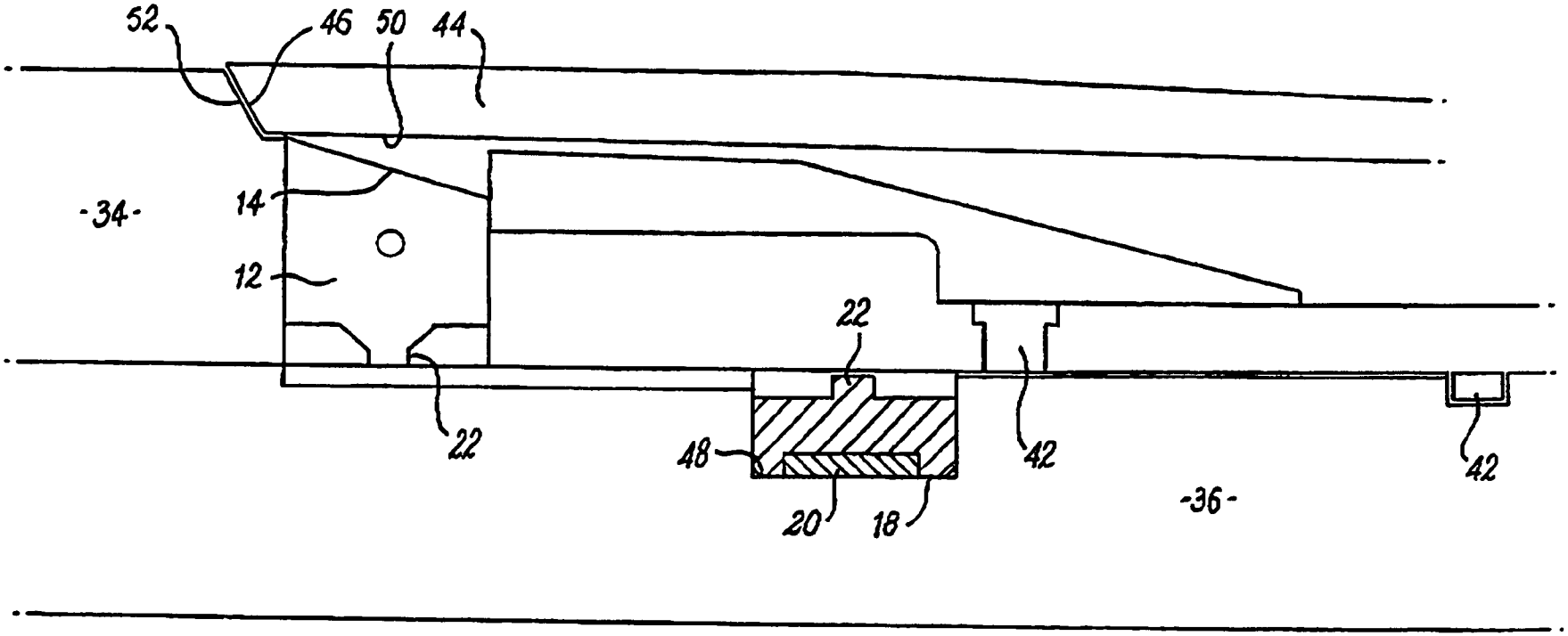
FIG. 3 is a schematic cross sectional view of the tool of FIG. 1 in the set position.

In the second position, the magnet 20 is located in the base of the recess 48 and the narrow section 22 lies on the shear plane 38. The button 12 is held in this position by the surface 50 of the PBR 44. This is illustrated in FIG. 3 where the tool has moved further into the well bore such that the surface 46 of the PBR 44 has contacted a surface 52 of the sleeve 34. Further this contact has caused the sleeve 34 to remain stationary relative to the tool body 36. Weight applied to the tool body 36 now causes the shear pins 42 to shear along with the narrow section 22 of the safety mechanism 10. Once sheared the sleeve 34 moves relative to the tool body 36 to set the tool as shown in the Figure. While the tool is being set the button 12 is always held in the second position, where it may be sheared, by the continued contact of the surface 50 of the PBR 44 with the face 16 of the button 12. Thus the dual function of the PBR 44 in both holding the button 12 in the second position while contacting the sleeve 34 to set the tool allows the tool only to be set by the PBR 44.

Once the button 12 has been sheared when the tool is set, the second bissell pin 28 holds the upper section 54 of the button 12 to the sleeve 34 to prevent it from becoming free and lodging somewhere in the tool where it may cause damage. Similarly, magnet 20 holds the lower section 40 of the sheared button 12 in the recess 48 against the tool body 36 and prevents it from interfering with the operation of the tool.

When the tool is retrieved, the button 12 may be removed from the sleeve 34 by inserting a screw into the aperture 32 and withdrawing the button 12. The lower section 40 may be removed via a magnet or by simply pulling on the remains of the narrow section 22.

Figure 4:
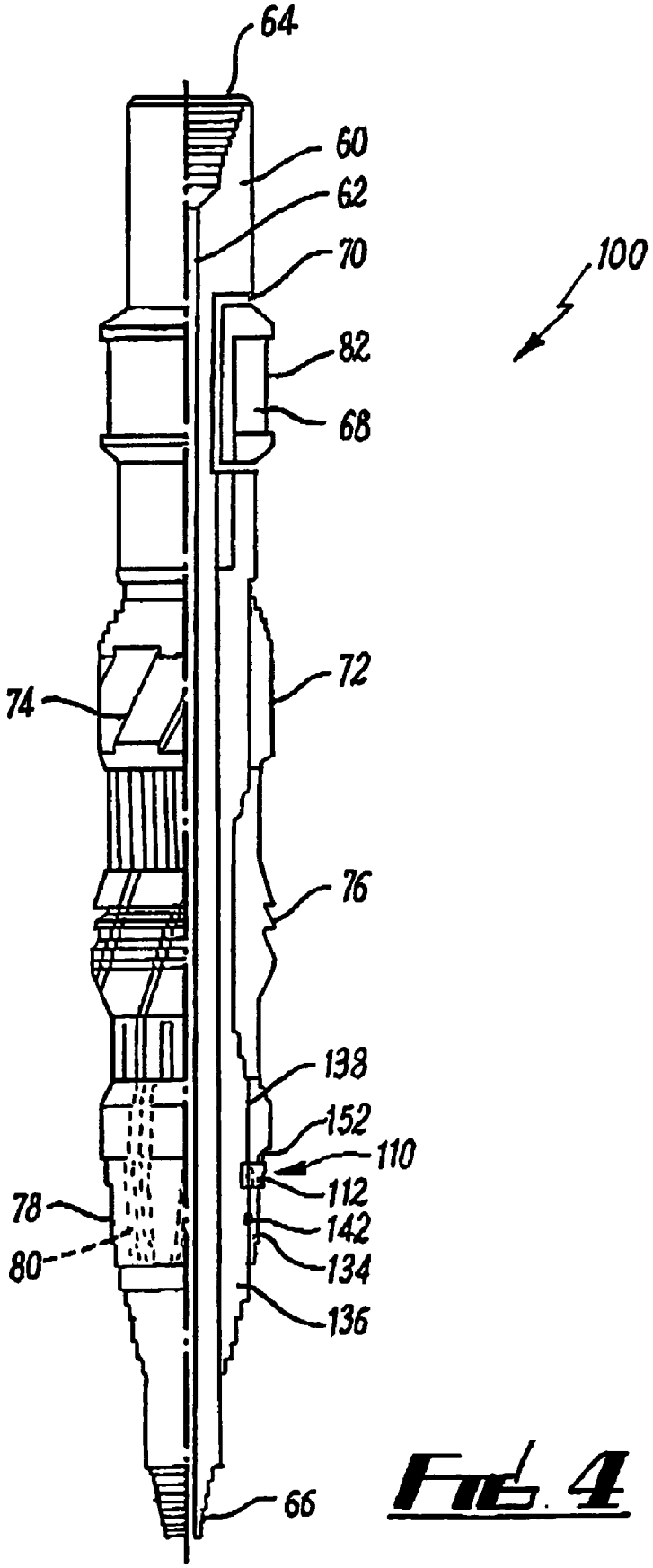
FIG. 4 is a schematic cross sectional view of a packer tool including a safety mechanism in accordance with the present invention.

Reference is now made to FIG. 4 of the drawings which illustrates a packer tool, generally indicated by reference numeral 100, in accordance with an embodiment of the present invention. In FIG. 4 like parts to those of the other Figures have been given the same reference numeral with the addition of 100.

Packer tool 100 comprises a one piece full strength drill pipe mandrel 60, making up the tool body 136, and having a longitudinal bore 62 therethrough. A box section 64 connection is located at a top end of the mandrel 60 and a threaded pin section 66 is located at a bottom end of the mandrel 60. Sections 64,66 provide for connection of the packer tool 100 to upper and lower sections of a drill pipe (not shown).

Mounted on the mandrel 60 is a compression set packer 68 with integral by pass means 70 which will be described hereinafter with regard to operation of the tool 100.

Below the packer 68 is a stabiliser sleeve 72. Sleeve 72 is rotatable with respect to the mandrel 60. Raised portions or blades 74 provide a 'stand off' for the tool 100 from the walls of the well bore and lower torque on the tool 100 during insertion into the well bore.

Located below the stabiliser sleeve 72 is a Razor Back Lantern (Trade Mark) 76. The Lantern 76 provides a set of scrapers for cleaning the well bore prior to setting the packer 68. Though scrapers are shown it will be appreciated that the scrapers could be replaced by brushes or other suitable cleaning means.

The safety mechanism 110 and the contact surface 152 of the sleeve 134 are located on a top dress mill 78 at a lower end of the tool 100. The top dress mill 78 can be used to dress off the PBR (not shown) top if required, while a section 80 of the top dress mill 78 can be used to clean the inside walls of the PBR.

The tool 100 operates as described hereinbefore with reference to FIGS. 1 to 3. When run in the bypass means 70 is open allowing fluid to flow around, behind the packer and thus reduce the amount of debris contacting the packer outer surface 82. Setting down a weight of approximately 12,000 lbs will cause the sleeve 134 to engage with the PBR and the safety mechanism 110 and the shear pins 142 to shear. A 'shear shudder' will be felt on the drill string at the surface. Additionally the sleeve 134 will move across the bypass channel around the packer and it will be closed off. At the same time the sleeve contacts the base of the packer 68. The upper end of the packer is fixed to the tool body 136. Setting down further weight on the tool 100, typically 20,000 lbs of applied weight, forces the base of the packer against the sleeve 134 which causes the packer to be compressed and as a result the rubber material of the packer 68 is compressed axially while expanding radially. Thus the packer 68 expands until the outer surface 82 meets and seals against the wall of the well bore or casing, if used. The packer is therefore set. Additionally the packer 68 can be unset by merely lifting the tool off the PBR whereupon the sleeve will fall back to its original position thereby releasing the packer 68 and opening the bypass means 70.

The principle advantage of the present invention is that it prevents premature setting of a weight set downhole tool before the tool has landed on the selected formation.

A further advantage of the present invention is that it provides a failsafe compression set packer tool which allows an inflow or negative test to be carried out on a liner over-lap and the liner shoe-track on the same trip as the well bore clean-up. The tool further eliminates the need for a controlled displacement of the whole well to lighter density fluid through use of the retrievable packer to perform the test.

Modifications may be made to the embodiments described herein without departing from the scope thereof.

The invention claimed is:

1. A safety mechanism for use in a weight set downhole tool to prevent the tool from setting before an operating element of the tool has landed on a selected formation in a well bore, the mechanism comprising a button mounted in a first position to lock the operating element to the tool body, the button having a face engageable with the selected formation, whereupon engagement with the selected formation moves the button from the first position to a second position, disengaging the lock, and wherein the button is maintained in the second position by the selected formation while the operating element contacts the selected formation thereby setting the tool.

2. A safety mechanism as claimed in claim 1 wherein the button comprises a body which is mounted through a portion of the operating element and a portion of the tool body to lock each together.

3. A safety mechanism as claimed in claim 2 wherein the body of the button is substantially cylindrical.

4. A safety mechanism as claimed in claim 1 wherein the safety mechanism further includes retaining means to hold the button to the tool once the tool is set.

5. A safety mechanism as claimed in claim 4 wherein the retaining means comprises one or more bissell pins.

6. A safety mechanism as claimed in claim 4 wherein the retaining means comprises a magnet, the magnet being mounted on a surface to attract another surface and hold the two surfaces together.

7. A safety mechanism as claimed in claim 1 wherein the face of the button is held standing out from the tool in the first position.

8. A safety mechanism as claimed in claim 7 wherein the face is located facing the selected formation to engage the selected formation.

9. A safety mechanism as claimed in claim 7 wherein the face is a plane surface located at an acute angle to the tool in the first position.

10. A safety mechanism as claimed in claim 1 wherein the button includes a shearable portion.

11. A weight set downhole tool, the tool including a tool body mountable on a work string, an operating element slidably mounted on the tool body which operates the tool by contacting a formation in a well bore, shearable retaining means to hold the operating element to the tool body until such time as adequate force is applied to shear the retaining means, and a safety mechanism to prevent shearing of the retaining means until the operating element has contacted a selected formation.

12. A weight set downhole tool as claimed in claim 11 wherein the operating element is a sleeve.

13. A weight set downhole tool as claimed in claim 11 wherein the shearable retaining means is one or more shear pins.

14. A weight set downhole tool as claimed in claim 11 wherein the selected formation is a polished bore receptacle.

15. A weight set downhole tool as claimed in claim 11 wherein the safety mechanism is according to claim 1.

16. A weight set downhole tool as claimed in claim 11 wherein the downhole tool is a circulation tool.

17. A weight set downhole tool as claimed in claim 11 wherein the downhole tool is a packer tool.

18. A weight set downhole tool as claimed in claim 11 further comprising an integral bypass means to allow fluid to pass through the tool as it is run into the well bore.

19. A weight set downhole tool as claimed in claim 18 wherein the bypass means are ports or channels.

20. A weight set downhole tool as claimed in claim 18 wherein the bypass means are opened or closed by virtue of the movement of the operating element when the tool is set.

21. A weight set downhole tool as claimed in claim 11 wherein the downhole tool further includes cleaning means.

22. A weight set downhole tool as claimed in claim 21 wherein the cleaning means comprises brushes, scrapers or milling elements.

23. A weight set downhole tool as claimed in claim 21 wherein the cleaning means are mounted below the operating element.

24. A weight set downhole tool as claimed in claim 21 wherein the cleaning means are located on the operating element.

25. A method of preventing a weight set downhole tool setting prematurely before an operating element of the tool has landed on a selected formation, the method comprising the steps:

a) running a weight set downhole tool including a safety mechanism into a well bore on a work string;

b) engaging a face of the safety mechanism on to the selected formation to move the safety mechanism to a released position; and c) engaging the operating element on to the selected formation to set the tool while the selected formation maintains the safety mechanism in the released position.

26. A method as claimed in claim 25 further including the step of shearing the safety mechanism when the tool is set.

27. A method as claimed in claim 25, wherein:

the step of running the downhole tool into the well bore comprises running the tool with a button of the safety mechanism mounted in a first position where the button locks the operating element to a body of the tool;

and wherein the step of engaging the face of the safety mechanism on the selected formation comprises engaging a face of the button with the selected formation, which moves the button from the first position to a second position, thereby disengaging the lock and moving the safety mechanism to the released position;

and further wherein the step of engaging the operating element on to the selected formation maintains the button in the second position to maintain the safety mechanism in the released position.

28. A safety mechanism for use in a weight set downhole tool to prevent the tool from setting before an operating element of the tool has landed on a selected formation in a well bore, the mechanism comprising a button, the button comprising a substantially cylindrical body mounted in a first position in which the button is mounted through a portion of the operating element and a portion of the tool body to lock the operating element to the tool body, and wherein the button has a face engageable with the selected formation, whereupon engagement with the selected formation moves the button from the first position to a second position, disengaging the lock, and wherein the button is maintained in the second position by the selected formation while the operating element contacts the selected formation thereby setting the tool.

29. A safety mechanism for use in a weight set downhole tool to prevent the tool from setting before an operating element of the tool has landed on a selected formation in a well bore, the mechanism comprising:

a button mounted in a first position to lock the operating element to the tool body, the button having a face engageable with the selected formation, whereupon engagement with the selected formation moves the button from the first position to a second position, disengaging the lock, and wherein the button is maintained in the second position by the selected formation while the operating element contacts the selected formation thereby setting the tool; and a magnet to hold the button to the tool once the tool is set, the magnet being mounted on a surface to attract another surface and hold the two surfaces together.

30. A safety mechanism for use in a weight set downhole tool to prevent the tool from setting before an operating element of the tool has landed on a selected formation in a well bore, the mechanism comprising a button mounted in a first position to lock the operating element to the tool body, the button having a face engageable with the selected formation and a shearable portion, whereupon engagement with the selected formation moves the button from the first position to a second position, disengaging the lock, and wherein the button is maintained in the second position by the selected formation while the operating element contacts the selected formation thereby setting the tool.

31. A method of preventing a weight set downhole tool setting prematurely before an operating element of the tool has landed on a selected formation, the method comprising the steps:

a) running a weight set downhole tool including a safety mechanism into a well bore on a work string;

b) engaging a face of the safety mechanism on to the selected formation to move the safety mechanism to a released position;

c) engaging the operating element on to the selected formation to set the tool while the selected formation maintains the safety mechanism in the released position; and d) shearing the safety mechanism when the tool is set.

* * * * *